US005705887A

United States Patent [19]

Shaffer

[11] Patent Number: 5,705,887

[45] Date of Patent: Jan. 6, 1998

[54] FLUORESCENT LAMP WITH END OF LIFE ARC QUENCHING STRUCTURE

[75] Inventor: John W. Shaffer, Danvers, Mass.

[73] Assignee: Osram Sylvania Inc., Danvers, Mass.

[21] Appl. No.: 615,406

[22] Filed: Mar. 14, 1996

Related U.S. Application Data

[63] Continuation-in-part of Ser. No. 389,995, Feb. 17, 1995, abandoned.

[51] Int. Cl.[6] ..... H01J 1/62; H01J 17/04; H01J 5/50

[52] U.S. Cl. ..... 313/489; 313/631; 313/626; 313/331

[58] Field of Search ..... 313/489, 490, 313/491, 331, 626, 631; 315/119; 439/612

[56] References Cited

U.S. PATENT DOCUMENTS

| | | | |
|---|---|---|---|
| 3,560,790 | 2/1971 | Vollmer | 313/218 |
| 3,629,916 | 12/1971 | Vollmer | 29/25.17 |
| 3,840,324 | 10/1974 | Shaffer et al. | 431/93 |
| 4,055,686 | 10/1977 | Steinberg et al. | 427/124 |
| 4,105,910 | 8/1978 | Evans | 313/490 |
| 5,098,326 | 3/1992 | Groczyca et al. | 445/26 |
| 5,210,461 | 5/1993 | Pai et al. | 313/491 |
| 5,449,971 | 9/1995 | Scott et al. | 313/631 |
| 5,585,693 | 12/1996 | Shaffer | 313/489 |

FOREIGN PATENT DOCUMENTS

| | | |
|---|---|---|
| 1145384 | 3/1985 | U.S.S.R. . |
| 2137410 | 10/1984 | United Kingdom . |

*Primary Examiner*—Hezron E. Williams
*Assistant Examiner*—Daniel S. Larkin
*Attorney, Agent, or Firm*—Carlo S. Bessone

[57] ABSTRACT

A fluorescent lamp is disclosed containing a deposit of a dried metal hydride-containing paste. The dried metal hydride-containing paste has a decomposition temperature higher than the temperature present during normal lamp operation. At the end of the lamp life, an increase in lamp temperature decomposes the metal hydride-containing paste and releases hydrogen within the lamp. The presence of hydrogen causes the lamp to extinguish passively without significant end heating or glass cracking.

13 Claims, 3 Drawing Sheets

FLUORESCENT LAMP WITH END OF LIFE ARC QUENCHING STRUCTURE

CROSS-REFERENCE TO A RELATED APPLICATION

This application is a continuation-in-part of application. Ser. No. 08/389,995 filed on Feb. 17, 1995, now abandoned, and assigned to the Assignee of this application.

BACKGROUND OF THE INVENTION

1. Field of the Invention

The invention relates to fluorescent lamps, and is directed more particularly to a fluorescent lamp having therein means for quenching the arc in the lamp at the end of lamp life.

2. Description of the Prior Art

Fluorescent lamps are increasingly being used with electronic ballasts that operate the lamp at high frequencies. Often such ballasts are of the "instant start" type wherein the open circuit voltage is sufficiently high to ignite the lamp directly, without the need for a separate cathode heating current.

The end of lamp life occurs when one of the electrodes is depleted of its emissive coating. At power line frequencies and with low open circuit voltage ballasts, the lamp arc is passively extinguished when the first electrode fails. However, in the case of instant start ballasts, the lamp arc does not necessarily extinguish when the first electrode fails. The open circuit voltage provided by instant start ballasts is sufficiently high to cause the lamp to continue to operate in a "cold cathode" mode. During cold cathode operation, the cathode voltage rises from around 12 volts to 50 volts, or higher. Referring to FIGS. 1 and 2, there is illustrated a lamp 2 comprising a glass envelope 8 containing an electrode 4, 6. An end cap 16, having contact pins 18, is disposed at each end of envelope 8. A pair of lead wires 12, 14 support a tungsten coil 10. A portion 20 of each lead wire 12, 14 is connected to a contact pin 18 on end cap 16. Upon failure of the first electrode 6, ion bombardment heats tungsten coil 10, lead wires 12, 14, and any other metallic structures within glass envelope 8. The heating of the metallic components is to such a high temperature that the components provide sufficient thermionic and secondary electron emission to sustain the arc. As a result, the end of the envelope 8 heats far above its normal operating temperature. The lead wires 12, 14 within the envelope 8 can become molten and melt through the envelope and/or cause the envelope to crack and sometimes break upon removal of the lamp from a fixture. The excessive heating of the lamp end can also cause damage to a socket or lamp fixture in which the lamp is mounted, or melting of a plastic lamp base.

To alleviate the problem, instant start electronic ballasts have been designed with additional circuitry to sense a rise in lamp voltage, or other events occurring upon cathode depletion, and shut down the system. However, such additional electronic components significantly increase the cost of the ballast. Further, many ballasts which do not include such a feature already exist in present lamp installations.

Accordingly, there exists a need for a fluorescent lamp which self-contains means for arc shut-down at the end of life of the lamp, which shut-down means does not include or require additional circuitry or electronic components.

SUMMARY OF THE INVENTION

An object of the invention is, therefore, to provide a fluorescent lamp having means therein for causing arc shut-down at the end of lamp life.

A further object of the invention is to provide a fluorescent lamp having such means for arc shut-down wherein the shut-down means requires no additional circuitry or electronic components.

With the above and other objects in view, as will hereinafter appear, a feature of the invention is the provision of a fluorescent lamp comprising a glass tube, an electrode at each end of the tube, each of the electrodes comprising a pair of lead wires extending through a sealed end of the tube and joined to a coil, and a deposit of metal hydride-containing paste disposed in the tube and having a decomposition temperature higher than temperatures within the tube during normal operation of the lamp.

The above and other features of the invention, including various novel details of construction and combination of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
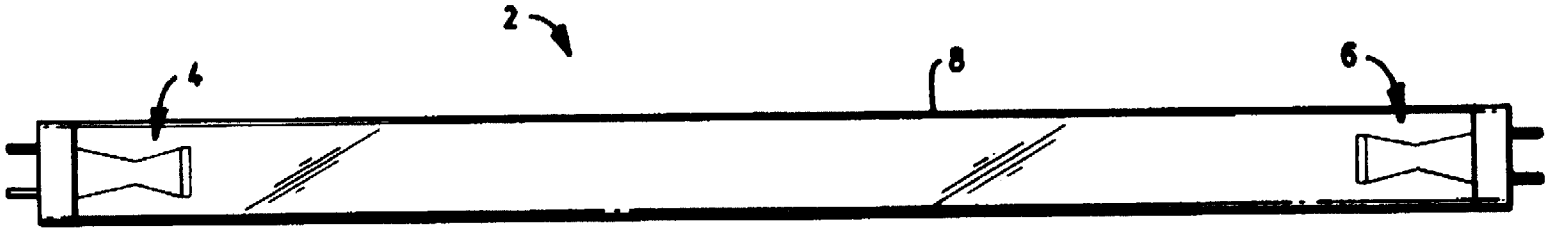
PRIOR ART FIG. 1
FIG. 1 is a side elevational view of a prior art fluorescent lamp.
Figure 2:
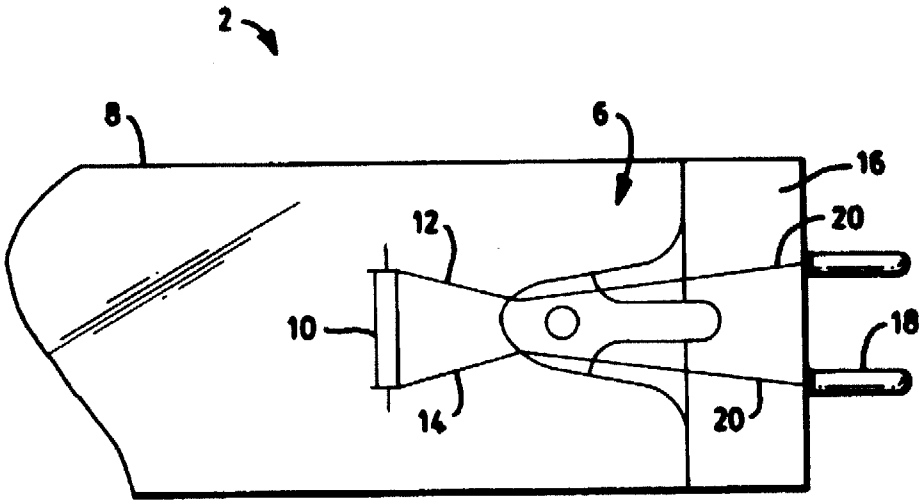
PRIOR ART FIG. 2
FIG. 2 is an enlarged diagrammatic view of an end portion of the lamp of FIG. 1.
Figure 3:
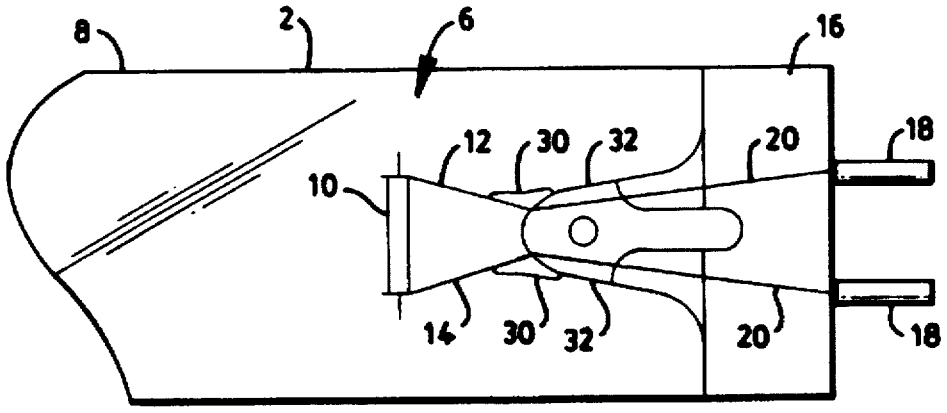
FIG. 3 is similar to FIG. 2, but shows one form of fluorescent lamp illustrative of an embodiment of the invention.

Referring to FIG. 3, there is shown a fluorescent lamp 2 comprising a glass tube 8. An electrode 4, 6, (one shown in FIG. 3) is disposed at each end of the tube 8. A pair of lead wires 12, 14 extend through each sealed end of the tube and are joined to a coil 10 to form the electrodes. A deposit 30 of metal hydride-containing paste is disposed in the tube 8 and is provided with a decomposition temperature higher than temperatures within the tube 8 during normal operation of the lamp. During normal lamp operation, the temperature of the paste is preferably maintained at about 150° C. or less. It will be seen that the electrode 6 is similar to that shown in FIG. 2, but has disposed on each of the lead wires 12, 14 the metal hydride-containing deposit 30. The deposit 30 preferably is joined to the lead wires 12, 14 at each end of the tube 8 at a point at which the lead wires 12, 14 emerge from a glass seal 32, that is, at the lead wire-glass seal interface.

In operation, at the end of the lamp life, caused by depletion of the cathode coating at one end of the lamp, the coil 10 in that end of the lamp rises to a temperature much higher than its normal operating temperature and is eventually burned off. The arc then attaches to a lead wire 12 or 14 and raises the temperature of that wire. Heat conducted down the wire thermally decomposes the metal hydride-containing paste deposit 30, and hydrogen is released within the lamp. During this period, the temperature of the paste reaches 650° C. or higher. The presence of hydrogen in the tube 8 raises the voltage required to sustain the discharge well above that provided by instant start ballasts, causing the lamp to go out passively, without significant end heating or glass cracking. The hydrogen release occurs rapidly enough to prevent damage to a fixture retaining the affected lamp. The quantity of hydrogen released, typically about one Torr-liter from a five milligram deposit, is sufficient to quench the arc in larger fluorescent lamps.

A preferred embodiment of paste is formulated by mixing 40 parts by weight of finely powdered titanium hydride and 60 parts by weight of (20 percent by weight) colloidal alumina suspension in water. A deposit of this paste, which, when dried, weighs about five milligrams, is applied to the base of each lead wire 12, 14 where the lead wire emerges from the glass seal 32.

Alternative paste embodiments may be used, including binders other than colloidal alumina. Preferably, the binder is inorganic and not subject to outgassing once dried, such as, for example, montmorillonite clays and various silicates.

Figure 4:
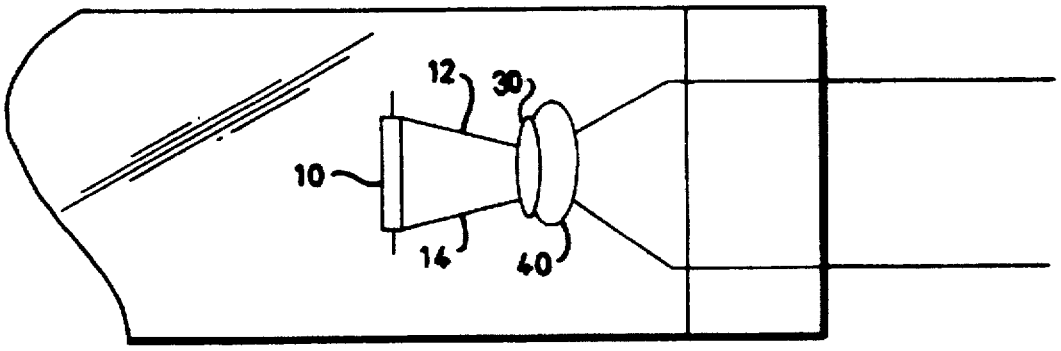
FIG. 4 is similar to FIG. 3, but shows another form of fluorescent lamp illustrative of an alternative embodiment of the invention.

Referring to FIG. 4, there is illustrated an electrode configuration wherein a glass bead 40 is fixed on the two lead wires 12, 14 and the deposit 30 preferably is disposed on the surface of the glass bead nearest the coil 10, though the deposit may be applied to the sides or surface most removed from the coil. As shown in FIG. 4, the surface of the glass bead 40 supports a single deposit 30 which extends between and surrounds the two lead wires 12, 14 where they emerge from the surface of the glass bead.

In some instances where deposit 30 is applied as shown in FIG. 4, the electrical voltage applied across the two lead wires during the cathode breakdown or activation stage of lamp manufacturing may cause arc-over through the deposit. Such an arc-over during lamp manufacturing may cause premature release of hydrogen which results in a failure of the lamp to light or a failure of the desired passive quenching of the discharge at end of life because the deposit has already decomposed. The type of failure that may result is determined by when the arc-over occurs relative to the active pumping of the lamp during the final stages of lamp processing.

Figure 5:
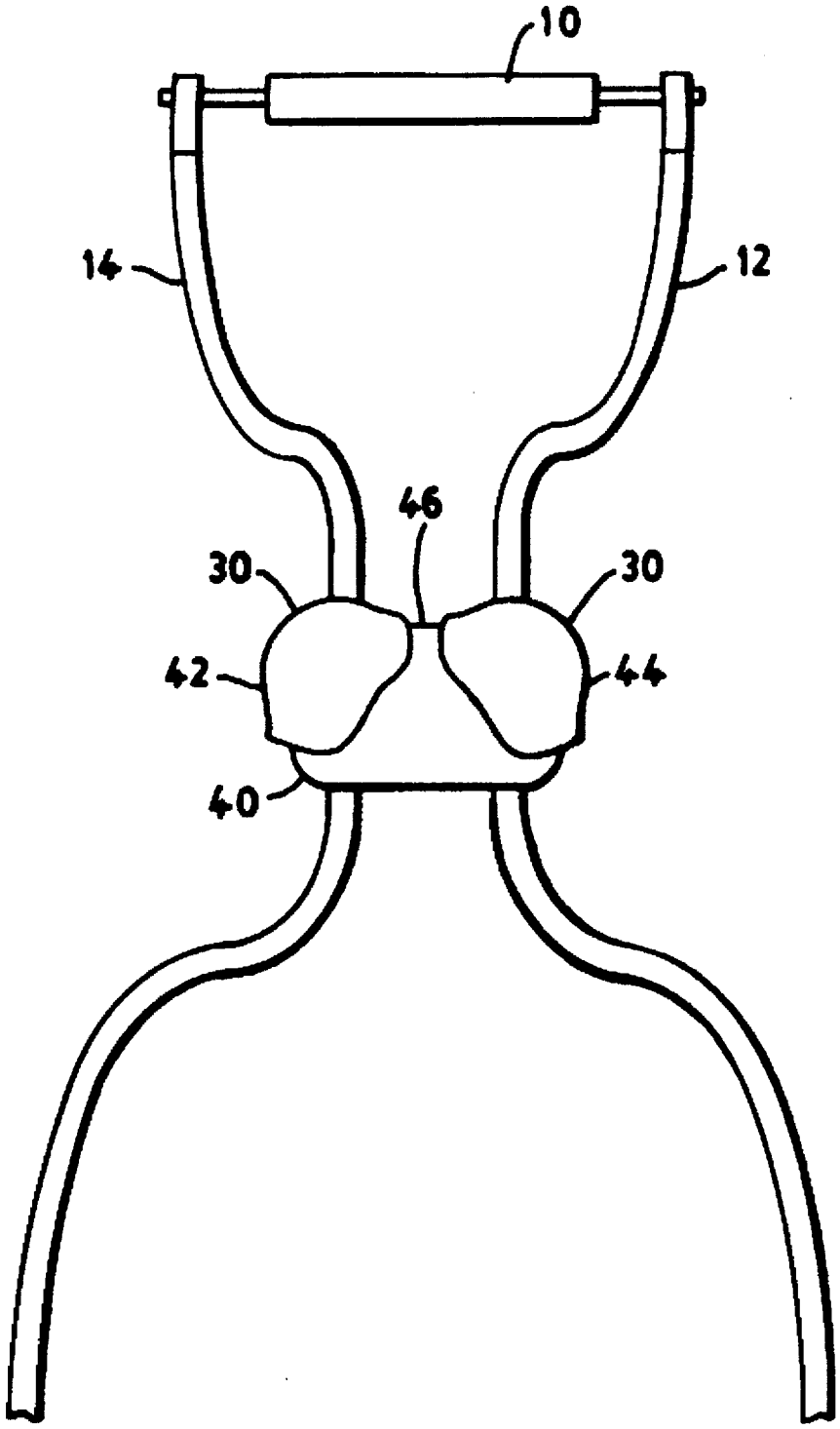
FIG. 5 is an enlarged elevational view of an electrode mount configuration for use in a fluorescent lamp illustrative of an alternative embodiment of the invention.

Referring to FIG. 5, there is illustrated an electrode mount configuration similar to that shown sealed in the lamp of FIG. 4 wherein a glass bead 40 is fixed on the two lead wires 12, 14. However in FIG. 5, two discrete, non electrically connected portions 42, 44 are disposed on the glass bead surface at locations where each lead wire emerges from the glass bead. A physical gap 46 separates the two portions 42, 44. The gap 46 can be dimensionally small, so long as the separation is sufficient to prevent an electrical discharge or a current to flow through the deposits during all stages of lamp processing. Typically, the length of gap 46 is on the order of at least one millimeter.

The preferred metal hydride is titanium hydride, $TiH_{1.7}$. The metal hydride can be selected from a group including titanium, zirconium, hafnium, alloys of these metals with one another, and alloys of these metals with other metals such as cobalt, iron, nickel, manganese, lanthanum, or combinations of these other metals.

There is thus provided a fluorescent lamp having means therein for causing shut-down at the end of lamp life, which means requires no additional circuitry or electronic components. The costs associated with the shut-down means are trivial and much lower than the cost of providing a shut-down circuit in the ballast, even though the ballast may survive several lamp lives.

It is to be understood that the present invention is by no means limited to the particular constructions herein disclosed and/or shown in the drawings, but also comprises any modifications or equivalents within the scope of the claims.

Having thus described my invention, what I claim as new and desire to secure by Letters Patent of the United States is:

1. A fluorescent lamp comprising:

a glass tube;

an electrode at each end of said tube; each of said electrodes comprising a pair of lead wires extending through a glass bead and joined to a coil; and a deposit of dried metal hydride-containing paste disposed on said glass bead, said deposit having a decomposition temperature higher than temperatures within said tube during normal operation of said lamp.

2. The fluorescent lamp in accordance with claim 1 wherein said deposit is disposed on said glass bead at the juncture of said glass bead and said lead wires extending therefrom.

3. The fluorescent lamp in accordance with claim 1 wherein said deposit comprises a single deposit extending between and surrounding said pair of lead wires adjacent to a surface of said glass bead.

4. The fluorescent lamp in accordance with claim 1 wherein said deposit comprises two discrete portions separated by a gap.

5. The fluorescent lamp in accordance with claim 1 wherein said deposit is disposed on a surface of said glass bead nearest said electrode.

6. The fluorescent lamp in accordance with claim 1 wherein said metal hydride contained in said paste is a selected one from a group consisting of titanium, zirconium, hafnium, a titanium-zirconium alloy, a titanium hafnium alloy, and a zirconium-hafnium alloy.

7. The fluorescent lamp in accordance with claim 1 wherein said metal hydride comprises an alloy consisting of a selected one from a group consisting of titanium, zirconium, and hafnium, and a selected one from a group consisting of cobalt, iron, nickel, manganese, and lanthanum.

8. The fluorescent lamp in accordance with claim 1 wherein said metal hydride comprises titanium hydride.

9. A fluorescent lamp comprising:

a glass tube;

an electrode at each end of said tube; each of said electrodes comprising a pair of lead wires extending through a glass seal at an end of said tube and joined to a coil; and a deposit of dried metal hydride-containing paste disposed on said glass seal, said deposit having a decomposition temperature higher than temperatures within said tube during normal operation of said lamp.

10. The fluorescent lamp in accordance with claim 9 wherein said deposit is disposed on said glass seal at the juncture of said glass seal and said lead wires extending therefrom.

11. The fluorescent lamp in accordance with claim 9 wherein said metal hydride contained in said paste is a selected one from a group consisting of titanium, zirconium, hafnium, a titanium-zirconium alloy, a titanium hafnium alloy, and a zirconium-hafnium alloy.

12. The fluorescent lamp in accordance with claim 9 wherein said metal hydride comprises an alloy consisting of a selected one from a group consisting of titanium, zirconium, and hafnium, and a selected one from a group consisting of cobalt, iron, nickel, manganese, and lanthanum.

13. The fluorescent lamp in accordance with claim 9 wherein said metal hydride comprises titanium hydride.

* * * * *